United States Patent [19]

Petroff et al.

[11] Patent Number: 5,036,908

[45] Date of Patent: Aug. 6, 1991

[54] HIGH INLET ARTERY FOR THERMOSYPHONS

[75] Inventors: Christopher Petroff; Andrew Lowenstein, both of Cambridge, Mass.

[73] Assignee: Gas Research Institute, Chicago, Ill.

[21] Appl. No.: 260,010

[22] Filed: Oct. 19, 1988

[51] Int. Cl.[5] ..... F28D 15/02

[52] U.S. Cl. ..... 165/104.21; 165/104.19; 165/104.29; 165/135

[58] Field of Search ..... 165/104.19, 104.21, 165/104.29, 135

[56] References Cited

U.S. PATENT DOCUMENTS

| | | | |
|---|---|---|---|
| 2,893,706 | 7/1959 | Smith | 165/104.19 |
| 3,902,549 | 9/1975 | Opfermann | 165/104.25 |
| 3,986,550 | 10/1976 | Mitsuoka | 165/104.21 |
| 4,020,898 | 5/1977 | Grover | 165/104.26 |
| 4,036,291 | 7/1977 | Kobayaski et al. | 165/104.21 |
| 4,058,159 | 11/1977 | Iriarte | 165/104.21 |
| 4,574,877 | 3/1986 | Klein | 165/104.21 |
| 4,640,347 | 2/1987 | Grover et al. | 165/104.21 |

OTHER PUBLICATIONS

Fukuda et al., "Characteristics of Closed Thermosyphon with Internal Downcomer–App. to Solar Collector Panel–".

Christopher Petroff, "The Effect of Liquid Inventory on the Performance of a Closed Two-Phase Thermosyphon", Ch. IV.

*Primary Examiner*—Albert W. Davis, Jr.

*Attorney, Agent, or Firm*—Lorusso & Loud

[57] ABSTRACT

There is disclosed a high inlet internal artery for use with thermosyphon tubes having condenser and evaporator sections. The high inlet internal artery allows such thermosyphons to operate above previously known maximum power throughput limits by drawing working fluid away from a stagnant pool area at the top of the condenser section of the thermosyphon tubes and transporting that fluid back into the evaporator section of the thermosyphon tube out of contact with upward flowing vapor which could impede the return of condensate. The high inlet artery of the present invention allows the circulation of liquid through a closed path and promotes increased thermal efficiency.

4 Claims, 3 Drawing Sheets

HIGH INLET ARTERY FOR THERMOSYPHONS

BACKGROUND OF THE INVENTION

This invention relates to a high inlet artery which can be used with a thermosyphon in order to alleviate problems of thermosyphon flooding and its consequences.

A thermosyphon is a closed end tube with evaporator and condenser sections, which contains a working fluid in equilibrium between its liquid and vapor phases. When sufficient heat is applied to the bottom of the thermosyphon, the pool of liquid at the bottom of the thermosyphon begins to boil. Cooling the top end of the thermosyphon causes the vapor produced from the boiling liquid to condense on the walls of the condenser and, driven by the force of gravity, to drain back to the liquid pool at the bottom. Due to the fact that the working fluid is constantly close to its saturation temperature, the thermosyphon is very effective in transferring large amounts of heat across a small cross-sectional area with only a small drop in temperature.

Thermosyphons powered by gas burners have been successfully tested in home and industrial applications such as space heating. The thermosyphons proposed for these applications may include a series of finned tubes that are attached to manifolds at their tops and their bottoms. The tubes are evacuated, and then prior to their being sealed are charged with a working fluid such as water. In use, the tubes are placed with their evaporator section in one chamber receiving combustion products of a burner. In that chamber, hot combustion gases are blown over the evaporator section of the tubes. In another chamber, room air to be heated is blown over the condenser section of the tubes to remove heat from the condensing working fluid.

A problem with this method of heating has been that in some installations, the evaporator section of the thermosyphons has been known to overheat, causing the thermosyphon tubing to melt. This can occur when the working fluid evaporates more rapidly than it can be replenished or the liquid return to the evaporator is impeded by upward flowing vapor. This phenomenon is known as flooding.

Other problems associated with thermosyphons involve various limiting factors of the operation of the units. One such factor that affects the power output of a thermosyphon is the amount of working fluid in it. In general, an increase in the amount of working fluid leads to a higher operating limit. One reason for this is that a large fill charge increases the average liquid level and thus puts a greater supply of liquid into the evaporator which is likely to increase heat transfer and operating limits. As a result, in most space heating applications thermosyphon tubes are charged to the point where their evaporators are hydrostatically full of liquid. A disadvantage in using a large fill charge, however, is that such a charge in the evaporator section of a thermosyphon increases the temperature gradient of the working fluid thus decreasing heat transfer. Also, a large fill charge can result in more liquid remaining in the condenser section, which impedes condensation.

Another problem associated with the manifolded thermosyphon design is that if there is overheating in one section of the thermosyphon tubes, due to the tubes being in communication with one another, the entire unit will overheat and fail. To avoid this, the tubes can be separated so that if one of the tubes fails for any reason, it will not cause the entire unit to fail. However, separating the tubes so that each tube acts independently leads to a further and unacceptable decrease in the operating limit.

These problems have been dealt with to some degree by presently employed internal arteries, which are placed inside of thermosyphons to assist in downward transport of condensate. These arteries are positioned coaxially with the thermosyphon tube with their inlets adjacent to the thermosyphon tube wall at the bottom of the condenser section of the thermosyphon tube. As a result, some of the condensate, after it has traveled through the condenser section of the thermosyphon tube, is taken out of the path of the upwardly flowing vapor by flowing into and down through the artery. The arteries also have the effect of allowing the condensation to reach the bottom of the evaporator section of the thermosyphon more quickly than had the condensation traveled the length of the thermosyphon along the side wall against the resistance of the upward flowing vapor.

However, these known arteries do not alleviate the problem of flooding caused by the upwardly moving vapor interfering with the return of liquid. The vapor velocities range from zero at either end of the thermosyphon to their maximum value in the adiabatic transition section between the evaporator and condenser. An artery whose inlet is at the bottom of the condenser is, therefore, in a region of maximum vapor velocity. As a result, at and directly above the artery inlet the liquid return is impeded by the high vapor velocity in this region of the thermosyphon tube. Condensate must reach the bottom of the condenser before any benefit of the artery is possible.

As power throughput into a thermosyphon is increased, the average liquid level in the thermosyphon rises due to the increased vapor velocity. If the liquid level rises past the top of the known artery, it can impede the entrance of liquid into it. Since the known artery has its inlet at the bottom of the condenser, it is necessary to pick a fill that will keep the liquid level below the artery inlet. This can allow the average liquid level to drop below the top of the evaporator and possibly lower the operating limit.

Another disadvantage of known arteries is that they require tilting the thermosyphon to allow the condensate to collect and drain into the entrance of the artery. As a result, thermosyphon tubes using known arteries cannot be operated vertically.

As a result, there is a need for a means by which flooding conditions in a thermosyphon can be relieved so that thermosyphons can be operated under high power conditions that would otherwise cause evaporator overheating and failure of the device. There is also a need for a means by which the fill charge used in a thermosyphon can be increased to prevent the possibility of lack of liquid in the evaporator without the associated increase in temperature gradient and loss of condenser effectiveness.

It is therefore an object of the present invention to provide a means by which the efficiency with which the working fluid in a thermosyphon is evaporated and condensed is optimized.

It is another object of the present invention to circumvent flooding so that a thermosyphon can be operated under higher power conditions than has heretofore been possible.

It is yet another object of the present invention to prevent evaporator dry-out and thermosyphon overheating.

It is still another object of the present invention to allow a larger fill charge of working fluid to be used in a thermosyphon, thus preventing the average liquid level from dropping below the top of the evaporator and decreasing the operating limit.

These and other objects of the invention will be shown with reference to the following description of the invention and the figures, in which like reference numbers refer to like members throughout the various views.

SUMMARY OF THE INVENTION

The above-described problems associated with thermosyphons are overcome by the system of the present invention which is a high inlet internal artery for use with a thermosyphon.

The high inlet artery in accordance with the present invention is an open-ended tube which is roughly equal in length to that of the inside of the thermosyphon. The inlet to the artery is located near the top of the condenser section of the thermosyphon and the outlet is located near the bottom of the evaporator section. Selection of the proper fluid inventory assures that the top of the condenser will almost always remain filled with liquid as long as the thermosyphon is running, thus giving the artery inlet a constant supply of liquid.

It is an important feature of the high inlet artery in accordance with the present invention that both ends of the artery are cut on an angle which is not perpendicular to the longitudinal axis of the artery to ensure that neither end becomes flush with either the top or bottom of the thermosyphon, which might prevent liquid from either entering or exiting the artery. Also, this construction allows working fluid that stagnates at a point just below the top of the thermosyphon to still have access to the inlet to the artery even if noncondensible gases occupy the top portion of the condenser section.

In use, the high inlet artery in accordance with the present invention is near or in contact with the top cap of the condenser section of the thermosyphon. As a result, liquid which begins to collect on that top cap will tend to run down through the high inlet artery to the evaporator section of the thermosyphon The evaporator section will, therefore, have a sufficient supply of working fluid to allow the thermosyphon to operate at maximum power.

BRIEF DESCRIPTION OF THE DRAWING

FIG. 3*a* shows moderate liquid fills with the average liquid level near the middle of the thermosyphon;

FIG. 3*b* shows the average liquid level near the top of the condenser; and

FIG. 3*c* shows the liquid level between the middle and the top of the thermosyphon.

DESCRIPTION OF THE PREFERRED EMBODIMENT

At the outset the invention is described in its broadest overall aspects with a more detailed description following. The present invention is a high inlet artery for use with closed two-phase thermosyphons. The broadest aspects of the present invention include an artery tube which is placed inside of a thermosyphon and which is roughly equivalent in length to the length of the thermosyphon tube. The artery is provided with an inlet at or near its top so that liquid which stagnates at the top of the condenser section of the thermosyphon is quickly and efficiently drawn away from that position and returned to the evaporator section of the thermosyphon.

In accordance with the present invention, the high inlet artery is a tube, preferably of thin walled copper or Teflon, which is positioned inside of a thermosyphon tube. The artery can either be rigidly affixed to the thermosyphon tube or for lower fabrication costs, can be placed loosely inside of it. In either case, the artery is made to be roughly equivalent in length to the thermosyphon tube, so as to extend from the top of the condenser section to the bottom of the evaporator section.

Figure 1:
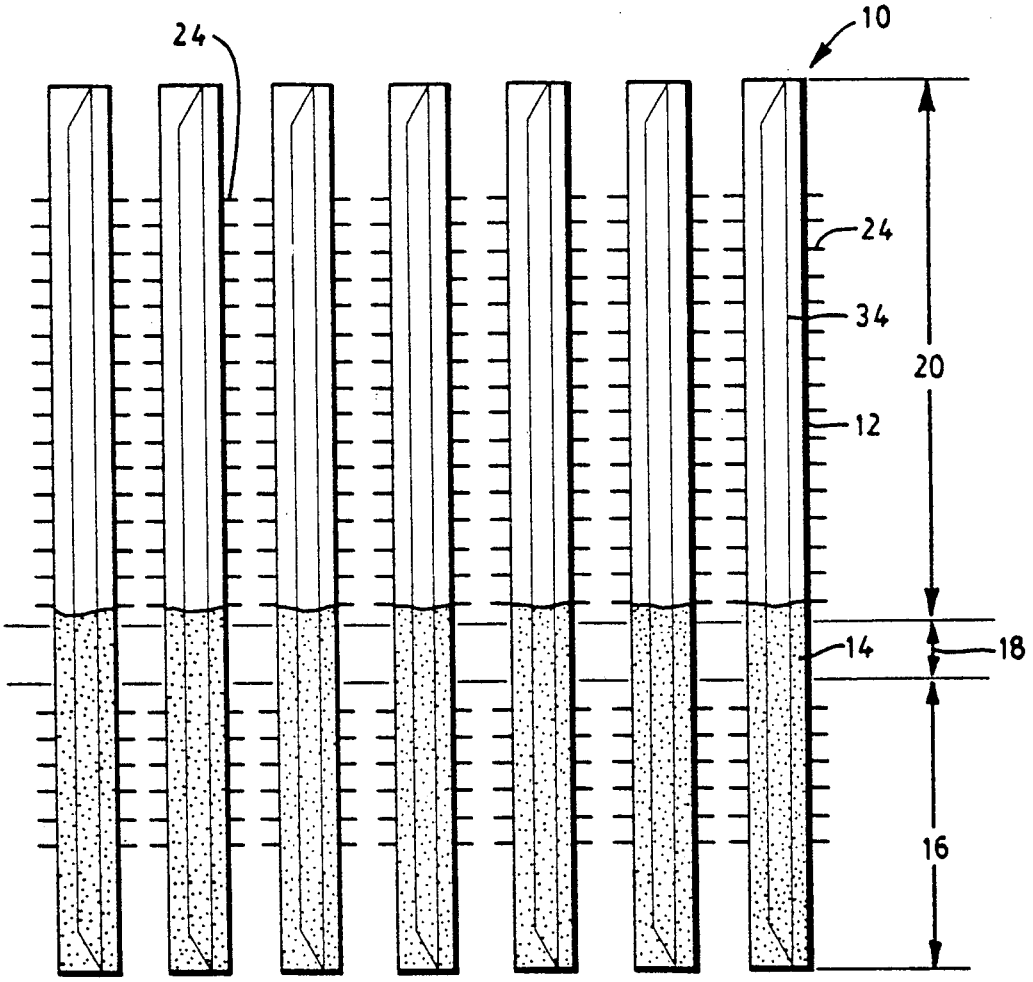
FIG. 1 is a schematic diagram of a thermosyphon system which includes the high inlet artery of the present invention.

In FIG. 1, there is shown a schematic representation of a thermosyphon heating system 10 suitable for use in gas burner space heating applications. Each thermosyphon tube 12 has heat fins 24 on it to facilitate heat transfer from the tubes 12 to or from the surrounding atmosphere. The thermosyphon tubes 12 have three sections: an evaporator section 16, an adiabatic, or transition section 18, and a condenser section 20. The liquid fill 14 is chosen by formulae that are later described herein to allow the proper length of stagnant liquid to exist when the thermosyphon is operating.

Figure 2:
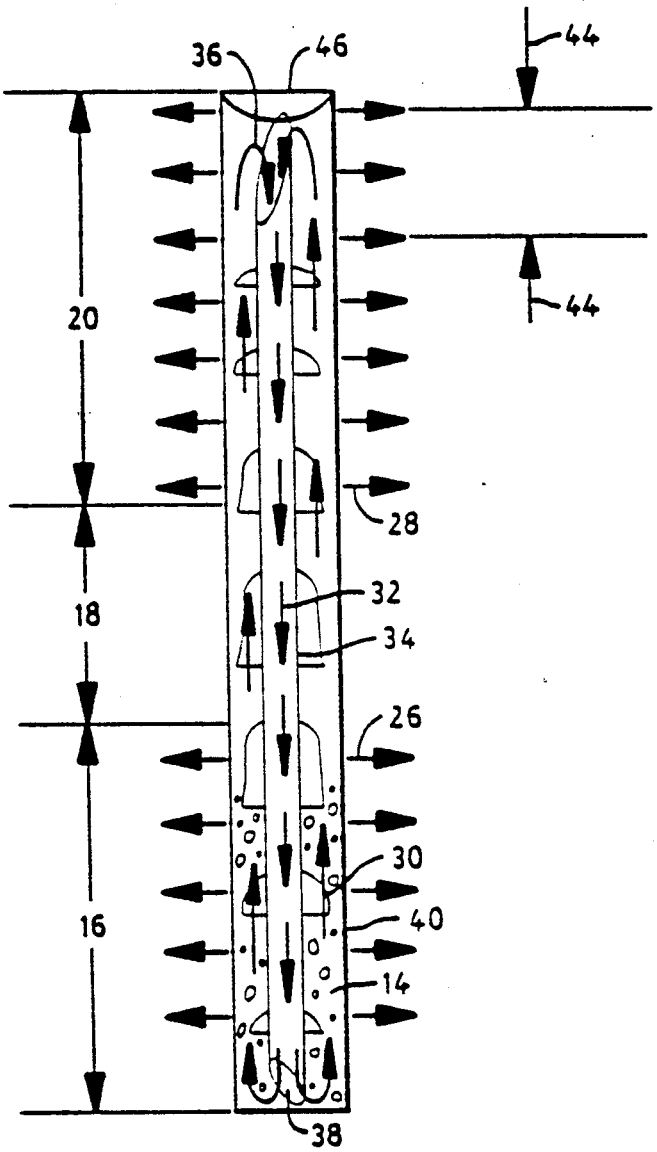
FIG. 2 is a schematic diagram of a single thermosyphon tube containing the high inlet artery of the present invention.

With reference now to FIG. 2, which shows a single thermosyphon tube 12, the evaporator section 16 of the thermosyphon tube 12 is placed inside of a heating chamber such as a chamber in communication with the exhaust of a gas-fired burner (not shown), and heat is applied as represented by arrows 26. The heating chamber is sufficiently sealed such that the hot combustion gases in the chamber are separate from the air to be heated which is directed over the condenser section 20 of the thermosyphon system. As a result of heating within the heating chamber, the working fluid 14 within the tubes 12 is brought to a boil. Upon boiling, the working fluid 14 vaporizes and, due to the resulting vapor being less dense than the other liquid in the tube is driven in the direction of upward vertical arrows 30 toward the condenser section 20 of the thermosyphon. The condenser section 20, having a temperature below the boiling point of the working fluid 14, causes the rising vapor bubbles of working fluid 14 to condense into the surrounding liquid. This temperature is maintained by circulating air to be heated around the walls of the condenser section 20, and is conventional to the relevant art. When the air passes over the condenser section 20 of the thermosyphon tube 12, heat is transmitted from the thermosyphon tube 12 represented by arrows 28, to the circulating air. As a result, the cool air is heated and is then directed through ducts, for example, to heat areas such as office or living spaces.

The high inlet artery of the present invention increases the operating limit of a thermosyphon by separating the downward moving liquid from the upward moving vapor. As shown in FIG. 2, the high inlet artery 34 is an open ended tube which is contained within and extends essentially the length of the thermosyphon tube 12. The high inlet artery 34 may, but need not be, rigidly attached to the thermosyphon tube 12. The artery 34 takes liquid from a stagnant pool in the area designated by arrows 44 which has collected in the top of the condenser 20 and, under the force of gravity, directly returns it in the direction of downward vertical arrows 32 to the bottom of the evaporator 16 of the thermosyphon tube 12. The liquid 14 is then available to be evaporated again and carried upward as vapor. When the vapor nears the top of the thermosyphon tube 12, it again condenses and can be removed by the high inlet artery 34 from the stagnant pool located in the area designated by arrows 44.

Figure 3:
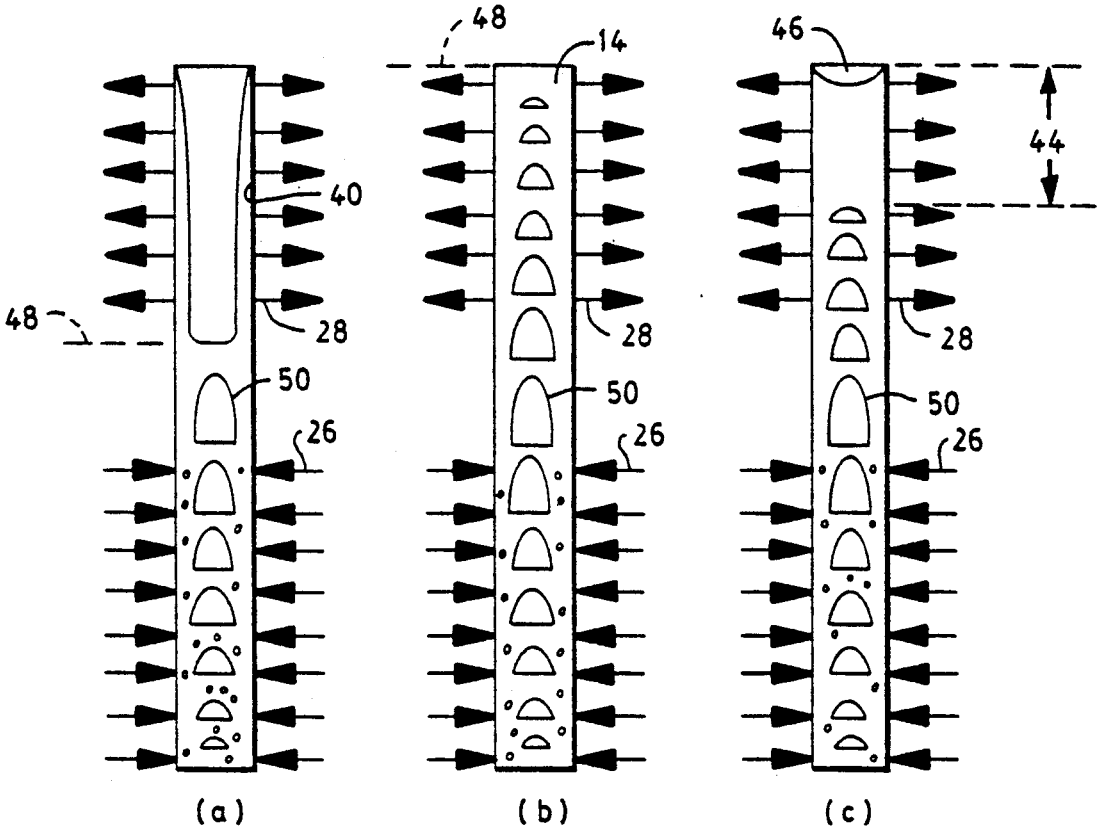
FIG. 3 is a schematic representation of typical vapor/liquid flow patterns in a thermosyphon corresponding to different fill levels of working fluid.

FIG. 3 shows the flow pattern for different liquid fills with the high inlet artery omitted for ease of illustration. The average liquid level 48 within the thermosyphon 12 increases from the hydrostatic level as the boiling action creates slugs of vapor 50. For moderate liquid fills (FIG. 3*a*) the average liquid level 48 will be near the middle of the thermosyphon 12 with condensate draining down the walls 40 above the average liquid level 48. When the average liquid level 48 reaches the top of the condenser 20 (FIG. 3*b*), instead of containing falling condensate film, the condenser contains rising slugs of vapor 50 that decrease in size as the vapor within them condenses into the surrounding liquid 14. For larger fill charges (FIG. 3*c*), the rising bubbles completely condense before they reach the top of the condenser 20 and a plug of liquid is permanently sustained at the top of the thermosyphon, creating a stagnant pool 44. Noncondensible gases 46, if present, will collect above the top of the stagnant pool 44. It should be noted that the presence of the stagnant pool 44 of liquid 14 only means that there is a large liquid fill and not that the flooding limit of operation has been reached.

Under the action of gravity, the high inlet artery 34 (FIG. 2) takes liquid 14 from this plug, or stagnant pool 44, and return it into the bottom of the evaporator 16. The evaporator 16 will therefore have a sufficient supply of working fluid 14 to allow the thermosyphon 12 to operate at its fullest capacity.

The reason the liquid will move through this closed path is that the pressure drop of the upward vapor/liquid flow 30 is less than the pressure drop of the gravity driven flow inside the high inlet artery 34 as indicated by arrows 32. The pressure drops work in opposition to each other. Increased vapor velocities increase the pressure drop of the upward vapor/liquid flow and thus can impede the flow of liquid down through the high inlet artery 34.

One advantage of using the high inlet artery of the present invention is that during flooding of the thermosyphon tube 12, condensed liquid can move downward in countercurrent flow out of contact with the vapor in the thermosyphon tube 12 so as to alleviate flooding. The high inlet artery 34 of the present invention will return not only the condensate that is formed in the condenser section 20 but also the liquid that is carried upward with the vapor. This dual effect is achieved because of the positioning of the high inlet artery 34 inlet 36. No matter how large the vapor velocities in the thermosyphon tube 12 become, fluid 14 will always be supplied to the high inlet artery 34 inlet 36 once a pool of liquid has formed at the top of the condenser section 20. Accordingly, there will be a constant supply of liquid to the evaporator section 16 of the thermosyphon tube 12. Thus, the high inlet artery 34 of the present invention allows for operation above the flooding limit which is defined as the operating point at which the liquid first starts to move co-current with the vapor.

One phenomenon which has negatively impacted thermosyphon performance in the past is the presence of noncondensible gases 46 at the top of the condenser Noncondensible gases 46 tend to collect above the stagnant pool 44 and could block the entrance of the high-inlet internal artery. To alleviate this problem, in a preferred embodiment of the present invention, the artery inlet 36 is cut on an acute angle to the longitudinal axis of the thermosyphon tube or is notched so that the inlet is elongated—i.e., extends from a point a specified distance from the top of the condenser to the top of the condenser.

Another problem that can interfere with an artery's proper operation is that of liquid boiling inside of the artery 34. If the artery is not rigidly affixed inside of the thermosyphon tube 12, it is possible that in some spots it could be in direct contact with the evaporator wall 40. In that event, high levels of heat could be transferred through the artery's walls to the liquid within, thereby causing boiling. Since the vapor that would result from that boiling would have a tendency to travel upwards, the continuous liquid supply to the evaporator 16 could be interrupted. To avoid this problem, the artery 34 can be rigidly secured inside of the thermosphon 12 so that it does not come into contact with the evaporator wall 40. Alternatively, the artery 34 can be constructed of a material with a low thermal conductivity such as Teflon or polypropylene so that if it did come into contact with the evaporator wall 40, sufficient heat would not be transferred to the fluid inside of the artery to cause boiling.

A final problem that could interfere with the artery's operation is picking the incorrect fill charge. If the fill charge is too large, the stagnant pool 44 will be too long and inhibit condensation. If the fill charge is too small, the stagnant pool will not be long enough to continuously supply the artery inlet with liquid An empirical relationship between the fill charge and the length of the stagnant pool in a vertical thermosyphon is given below.

The drift flux model developed by Wallis in his 1969, *One Dimensional Two-Phase Flow* (McGraw-Hill, NY) can be adopted to the thermosyphon configuration when the dimensionless inverse viscosity $$N_f = \frac{[D^3 g(\rho_f - \rho_g)\rho_f]^{\frac{1}{2}}}{\mu_f}$$

where

D = thermosyphon diameter g = gravitational acceleration $\rho$ = density $\mu$ = viscosity and the subscript f refers to the liquid phase and the subscript g refers to the vapor phase is greater than 300.

For a vertical thermosyphon the bubble drift velocity $$v_{gj} = K_1 \rho_f^{-\frac{1}{2}} [gD(\rho_f - \rho_g)]^{\frac{1}{2}}$$

where $K_1$ is a constant expressed in terms of $N_f$ and the Eötvos Number $N_{eö} = D^2 g(\theta_f - \theta_g)/\sigma$ ($\sigma$ is surface tension)

$$K_1 = 0.345[1 - e^{(-N_f/34.5)}][1 - e^{(3.37 - N_{eö})/10}]$$

Wallis gives values of $K_1$ for a tilted thermosyphon. In terms of the power throughput Q and the cross-sectional area of the annulus between the internal artery and the thermosyphon $A_x$) the value of the vapor superficial velocity in the adiabatic section is, $$j_{ga} = \frac{Q}{h_{fg} A_x \rho_g}$$

where $h_{fg}$ is the enthalpy of vaporization. The stagnant pool length under those operating conditions is:

$$L_b = L_c + \left[ \frac{L_e\left(\frac{1}{6} + \frac{1.6\, v_{gj}}{1.44\, j_{ga}} \ln \frac{1.6\, v_{gj} + 1.2\, j_{ga}}{1.6\, v_{gj}}\right) + L_a\left(1 - \frac{j_{ga}}{1.2\, j_{ga} + v_{gj}}\right) + L_c - \frac{V_i}{A_x}}{\frac{v_{gj}}{1.44\, j_{ga}} \ln\left(\frac{v_{gj} + 1.2\, j_{ga}}{v_{gj}}\right) - \frac{5}{6}} \right]$$

where $V_i$ is the volume of the initial fill charge of liquid placed in the thermosyphon minus the internal volume of the artery, and $L_e$, $L_a$ and $L_c$ are the lengths of the evaporator, adiabatic section and condenser respectively.

EXAMPLE

In a thermosyphon which consists of a 23.5 cm. long evaporator, a 12.7 cm. long adiabatic section and a 46.4 cm. long condenser (all three sections of which have an internal diameter of approximately 1.4 cm) the maximum operating limit using 10, 20, 40 or 60 ml of water as a working fluid is 1700 watts at 98° C. Loosely placing within the thermosyphon a copper tube internal artery with a 0.63 cm. outer diameter, a 0.47 cm. internal diameter, and which ran the entire length of the thermosyphon containing 50 ml of liquid, allowed an operating limit of approximately 5200 watts to be achieved. This is an increase of over 300% in the heat transfer limit of an equivalent thermosyphon system operating without a high inlet internal artery. The 50 ml of liquid created a calculated stagnant pool length of 15 cm. The artery's inlet notched by intersecting vertical and horizontal cuts at an angle to allow the entrance to extend 5 cm. below the top of the condenser and the artery's outlet extended 1 cm. above the bottom of the evaporator.

When the thermosyphon was operated with the artery and 55 ml of liquid at 120° C. and 2000 W total heat throughput, the temperature drop was 38% lower than when operating with 60 ml and 26% lower than when operating with 40 ml. The difference in performance is not as great when operating with 10 ml or 20 ml. However, these inventories had much lower operating limits.

The embodiments described above which utilize this invention are set out here by way of illustration but not of limitation. Many other embodiments which will be readily apparent to those skilled in the art may be made without materially departing from the spirit and scope of this invention. The invention, therefore, is to be defined by the claims that follow.

What is claimed is:

1. A thermosyphon system comprising:

at least one closed end thermosyphon tube of a specific length the longitudinal axis of which extends in a substantially vertical direction, said thermosyphon tube having a condenser section at its top end adapted to transfer heat to a fluid in contact with said condenser section and an evaporator section at its bottom end for receiving heat, said thermosyphon tube also defining a transition section between the condenser section and the evaporator section;

a working fluid within said thermosyphon tube, said working fluid being capable of being heated to form a vapor in the evaporator section for flowing to, and releasing heat at, said condenser section; and an artery, positioned within said thermosyphon tube and extending substantially parallel thereto, said artery being of substantially the same length as said thermosyphon tube and having an inlet near its top and an outlet near its bottom to provide a conduit for liquid which has been collected near the top of the condenser section to travel downwardly to the evaporator section without coming into direct contact with upward moving working fluid vapor, said artery providing a means by which a stagnant pool of liquid which builds up near the condenser section can circulate to the evaporator section to prevent the supply of liquid in the evaporator section from being depleted, the fill charge of said working fluid placed in the thermosyphon being selected so that the vertical length $L_b$ of the stagnant pool of liquid extending downwardly from the top of the thermosyphon tube is determined by the satisfaction of the formula:

$$L_b = L_c + \left[ \frac{L_e\left(\frac{1}{6} - \frac{1.6\, v_{gj}}{1.44\, j_{ga}} \ln \frac{1.6\, v_{gj} + 1.2\, j_{ga}}{1.6\, v_{gj}}\right) - L_a\left(1 - \frac{j_{ga}}{1.2\, j_{ga} + v_{gj}}\right) + L_c - \frac{V_i}{A_x}}{\frac{v_{gj}}{1.44\, j_{ga}} \ln\left(\frac{v_{gj} + 1.2\, j_{ga}}{v_{gj}}\right) - \frac{5}{6}} \right]$$

where $V_i$ is the volume of the initial fill charge of liquid working fluid placed in the thermosyphon tube minus the internal volume of the artery, $L_e$, $L_a$ and $L_c$ are the lengths of the evaporator, adiabatic and condenser section respectively, $A_x$ is the cross-sectional area of the annulus between the internal artery and the thermosyphon tube, $j_{ga}$ is the vapor superficial velocity given by $$j_{ga} = \frac{Q}{h_{fg} A_x \rho_g}$$

with $\rho_g$ the density of the vapor phase, Q the power throughput and $h_{fg}$ the enthalpy of vaporization, $v_{gj}$ is the bubble drift velocity given by $$v_{gj} = K_1 \rho_f^{-\frac{1}{2}} [gD(\rho_f - \rho_g)]^{\frac{1}{2}}$$

with D the thermosyphon diameter, g the gravitational acceleration, $\rho_f$ the density of the liquid phase and $K_1$ the constant $$K_1 = 0.345[1 - e^{(-N_f/34.5)}][1 - e^{(3.37 - N_{\sigma})/10}]$$

where $$N_f = \frac{[D^3 g(\rho_f - \rho_g)\rho_f]^{\frac{1}{2}}}{\mu_f}$$

with $\mu_f$ the liquid phase viscosity, and where $$N_{eö} = D^2 g(\rho_f - \rho_g)/\sigma$$

with $\sigma$ the surface tension.

2. The thermosyphon as set forth in claim 1 wherein the top of said artery is cut an acute angle to the vertical longitudinal axis of the thermosyphon tube so as to prevent blockage of said inlet by noncondensible gases at the top of the condenser section and to provide a substantial area through which fluid can enter the artery, and wherein the artery has closed tube walls apart from said inlet near its top and said outlet near its bottom.

3. The thermosyphon as set fort in claim 1 wherein the artery is formed of a minimally thermally conductive material selected from the group of Teflon-TM and polypropylene so as to avoid excess heat transfer to fluid within the artery so as to decrease the likelihood of boiling of the fluid within the artery.

4. The thermosyphon as set forth in claim 1 wherein the artery is loosely placed inside the thermosyphon tube.

* * * * *